US006412913B1

(12) United States Patent
Moon et al.

(10) Patent No.: US 6,412,913 B1
(45) Date of Patent: Jul. 2, 2002

(54) INK JET PRINTER HEAD AND METHOD FOR DISCHARGING INK FROM AN INK JET PRINTER HEAD USING A FLUID PRESSURE

(75) Inventors: Jae-Ho Moon, Suwon; Dae-Soon Lim, Yongin, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/836,367

(22) Filed: Apr. 18, 2001

(30) Foreign Application Priority Data

Jul. 25, 2000 (KR) ..... 2000-42863

(51) Int. Cl.[7] ..... B41J 2/04; B41J 2/015
(52) U.S. Cl. ..... 347/54; 347/21
(58) Field of Search ..... 347/20, 21, 23, 347/68, 70–72, 54

(56) References Cited

U.S. PATENT DOCUMENTS

| | | | | |
|---|---|---|---|---|
| 4,339,762 A | 7/1982 | Shirato et al. | ..... | 347/62 |
| 4,847,630 A | 7/1989 | Bhaskar et al. | ..... | 347/63 |
| 4,882,595 A | 11/1989 | Trueba et al. | ..... | 347/85 |
| 5,479,196 A | 12/1995 | Inada | ..... | 347/92 |
| 5,760,804 A | 6/1998 | Heinzl et al. | ..... | 347/56 |
| 5,850,241 A | 12/1998 | Silverbrook | ..... | 347/54 |
| 5,912,685 A | 6/1999 | Raman | ..... | 347/65 |
| 5,956,058 A | 9/1999 | Momose et al. | ..... | 347/71 |
| 6,019,457 A | 2/2000 | Silverbrook | ..... | 347/65 |

FOREIGN PATENT DOCUMENTS

| | | | | |
|---|---|---|---|---|
| EP | 0 652 108 A2 | 5/1995 | ..... | B41J/2/16 |

*Primary Examiner*—John Barlow
*Assistant Examiner*—Juanita Stephens
(74) *Attorney, Agent, or Firm*—Robert E. Bushnell, Esq.

(57) ABSTRACT

An ink jet printer head and method for discharging ink in an ink chamber through a nozzle hole by a fluid pressure of air. The ink jet printer head having a fluid chamber defined on or in a side of a silicon plate to be charged with a fluid, such as air, and a through-hole which communicates with an ink chamber. The ink jet printer head opens the through-hole by operating a piezo-actuator, pressures ink in the ink chamber, and pushes a tail of the ink during ink discharge. Accordingly, uniform shapes of ink droplets can be obtained resulting in a high resolution print.

24 Claims, 7 Drawing Sheets

INK JET PRINTER HEAD AND METHOD FOR DISCHARGING INK FROM AN INK JET PRINTER HEAD USING A FLUID PRESSURE

CLAIM OF PRIORITY

This application makes reference to, incorporates the same herein, and claims all benefits accruing under 35 U.S.C. §119 from an application entitled INK-JET PRINTER HEAD earlier filed in the Korean Industrial Property Office on the 25th day of Jul. 2000, and there duly assigned Serial No. 2000-42863.

BACKGROUND OF THE INVENTION

1. Field of the Invention

The present invention relates to an ink jet printer head, and more particularly to an ink jet printer head for discharging an ink droplet of an improved shape by a fluid pressure of air or the like, resulting in a high resolution print.

2. Description of the Related Art

Generally, an ink jet printer head is divided into a thermal type or a piezo-actuator type. A thermal ink jet printer head discharges ink in such a manner that a thin-film heater resistor instantly heats the ink, generating and expanding ink bubbles. A piezo-actuator ink jet printer head discharges ink by displacement of a piezo-actuator.

A thermal ink jet printer head exemplary of contemporary practice in the art discharges ink through a nozzle hole in such a manner that a thin-film heater resistor instantly heats ink of an ink chamber, generating and expanding ink bubbles. Accordingly, as the expanded ink bubbles pressure the ink chamber, the ink is discharged through the nozzle hole.

Also, a piezo-actuator ink jet printer head exemplary of contemporary practice in the art discharges ink through a nozzle hole in such a manner that electric power is applied to a piezo-actuator which is disposed on a silicon plate and opposite to a nozzle plate, thereby displacing the piezo-actuator. Accordingly, an ink chamber is pressured and the ink is discharged through a nozzle hole.

Since the thermal and piezo-actuator ink jet printer heads exemplary of contemporary practice in the art simply push the ink to discharge, a tail of an ink droplet is generated when the ink bubbles vanish or the displacement of the piezo-actuator is stopped. Since the tail of the ink droplet is usually lengthened and fragmented by a surface tension and a viscosity, a high resolution print typically can not be obtained.

U.S. Pat. No. 4,339,762 to Shirato et al. entitled Liquid Jet Recording Method disclose a liquid jet recording method capable of recording gradation includes filling with a liquid a conduit having, at the end, an orifice for ejecting and projecting a liquid droplet to a predetermined direction, the conduit being provided with a heat actuating portion generating a force for ejecting the liquid droplet by applying heat energy to the liquid to cause an abrupt state change. The heat actuating portion includes an electrothermal transducer having a heat generating portion such that the degree of heat supply is different from position to position on the heating surface, and controlling the strength of an input electric signal corresponding to the gradation of an image to be recorded.

U.S. Pat. No. 4,847,630 to Bhaskar et al. entitled Integrated Thermal Ink Jet Printhead And Method Of Manufacture disclose an integrated thermal ink jet printhead and manufacturing process which includes the successive build-up of an orifice plate, a first barrier layer, heater resistors, a second barrier layer, and an ink reservoir-defining layer on top of a reusable or "dummy" substrate. Lead-in conductors are formed integral with the heater resistors and openings are formed between ink reservoirs and the orifice plate to provide for ink flow under control of the heater resistors.

U.S. Pat. No. 4,882,595 to Trueba et al. entitled Hydraulically Tuned Channel Architecture disclose the use of lumped resistive elements in an ink feed channel between an ink-propelling element, such as a resistor, and an ink supply plenum. A secondary constriction in the ink feed channel is defined by a width sufficient to provide physical support for the resistive elements while avoiding resistance to ink refill. The printhead includes lead-in lobes for assisting in purging any bubbles in the ink.

U.S. Pat. No. 5,479,196 to Inada entitled Ink Jet Recording Apparatus And Method Of Recovery Ink Discharging Condition Of The Same discloses an ink jet recording apparatus that has a recording head provided with a plurality of ink discharging openings, ink paths leading to the ink discharging openings and an ink chamber commonly connected to the ink paths. Each ink path has a recording thermal energy generating element for causing film boiling of ink in the ink path so as to form a bubble of the ink vapor thereby discharging an ink droplet from the discharging opening. Tiny bubbles generated in each ink path as a result of the driving form a comparatively large void with which at least a part of the ink in each ink path is replaced so that stagnant bubbles are merged in the void and, hence, extinguished. The recording head can have an assisting thermal energy generating element which cooperates with the recording thermal energy generating element.

U.S. Pat. No. 5,760,804 to Heinzl et al. entitled Ink-Jet Printing Head For A Liquid-Jet Printing Device Operating On The Heat Converter Principle And Process For Making It disclose an ink print head of a sandwich type construction according to the bubble-jet principle. The heating elements and the shoot out openings are arranged so as to be laterally offset relative to one another in such a way that the spreading direction of the steam bubble is directed opposite to the ink shooting direction.

U.S. Pat. No. 5,850,241 to Silverbrook entitled Monolithic Print Head Structure And A Manufacturing Process Therefor Using Anisotropic Wet Etching discloses printing heads which operate using coincident forces, whereby nozzles are etched through a silicon substrate, allowing two dimensional arrays of nozzles for color printing, and drive transistors, shift registers, and fault tolerance circuitry can be fabricated on the same wafer as the nozzles.

U.S. Pat. No. 5,912,685 to Raman entitled Reduced Crosstalk Inkjet Printer Printhead discloses an ink jet printer printhead which employs two ink feed channels to couple an ink firing chamber to the source of ink. A first one of the ink feed channels has a lower fluid resistance to ink flowing in the channel than a second one of the ink feed channels. The first ink feed channel and the second ink feed channel each have an inlet to the ink source and are arranged such that the inlet of the first ink channel is closer to the ink firing chamber than the inlet of the second ink feed channel. Adjacent ink firing chambers are arranged such that a lower fluid resistance ink channel of one ink firing chamber is next to a higher fluid resistance ink channel of a neighboring ink firing chamber.

U.S. Pat. No. 5,956,058 to Momose et al. entitled Ink Jet Print Head With Improved Spacer Made From Silicon Single-Crystal Substrate disclose an ink jet printer head that includes a spacer including pressure generating chambers continuous to nozzle openings, ink supply paths, and reservoirs, a cover member for covering the pressure generating chambers in a sealing fashion, and pressure generating means for generating pressure in the pressure generating chambers in accordance with print data. One of the walls of a path hole for forming a pressure generating chamber is aligned with one of the walls of a path hole for forming a reservoir. Walls defining the path hole for forming a pressure generating chamber, which are located in the vicinity of a nozzle opening, are connected to each other at an obtuse angle.

U.S. Pat. No. 6,019,457 to Silverbrook entitled Ink Jet Print Device And Print Head Or Print Apparatus Using The Same discloses an ink jet print device that includes a passageway for flowing ink having an outlet for ejecting ink at one end. The passageway has a portion where the cross-sectional dimensions of the passageway change. A generating device which generates energy for ejecting ink from the outlet is disposed on a surface intersecting the passageway and defines a part of the portion where the cross-sectional dimensions of the passageway change.

European Patent Application EP 0 652 108 A2 to Momose et al. entitled Ink Jet Print Head And A Method Of Manufacturing The Same disclose an ink jet printer head that includes a spacer including pressure generating chambers continuous to nozzle openings, ink supply paths and reservoirs, a cover member for covering the pressure generating chamber in a sealing fashion, and pressure generating means for generating pressure in the pressure generating chambers in accordance with print data. One of the walls of a path hole for forming a pressure generating chamber is aligned with one of the walls of a path hole for forming the ink supply path. Walls defining the path hole for forming a pressure generating chamber, which are located in the vicinity of a nozzle opening, are connected to each other at an obtuse angle.

SUMMARY OF THE INVENTION

The present invention promotes overcoming the above-described problem in the above described ink jet printer heads of the related art. Therefore, it is an object, among other objects, of the present invention to provide an ink jet printer head for discharging of ink droplets of a uniform shape by a fluid pressure of air pressure or liquid pressure, for example, resulting in a high resolution print.

It is another object, among other objects, of the present invention to provide a method for discharging of ink droplets of a uniform shape from an ink jet printer head, by a fluid pressure of air pressure or liquid pressure, for example.

To accomplish the above object, and other objects of the present invention, the present invention provides an ink jet printer head including a nozzle plate having a plurality of nozzle holes or nozzle openings, a base plate disposed adjacent to the plurality of nozzle holes for defining an ink flow path and an ink chamber, and an ink discharge device disposed correspondingly to the nozzle plate across the base plate, for discharging ink of the ink chamber through the nozzle hole or the plurality of nozzle holes by a fluid pressure by contacting the ink with a fluid.

According to the present invention, the ink discharge device includes a through-hole or aperture or a plurality of through-holes or apertures formed in the base plate correspondingly to a nozzle hole or to a plurality of nozzle holes, a fluid chamber defined in or on a side of the base plate to be charged with the fluid, an opening valve or a plurality of opening valves for selectively opening and closing a corresponding through-hole or a corresponding plurality of through-holes, and an operation unit for operating a corresponding opening valve.

According to a preferred embodiment of the present invention, the operation unit includes an actuator for selectively ascending and descending the opening valve. It is preferable that the actuator includes a piezo-actuator layered on the opening valve, a plurality of electrode plates for driving the piezo-actuator, and a power supply for applying electric power to the electrode plates.

Another object, among other objects, of the present invention also provides a method for discharging ink from an ink jet printer head including the steps of: selectively supplying and charging ink to an ink chamber which is formed between or in communication with a base plate and a nozzle plate having a nozzle hole or opening or having a plurality of nozzle holes or nozzle openings; pressuring the ink of the ink chamber by partially contacting the ink with a fluid; discharging the ink of the ink chamber through the nozzle hole or the plurality of nozzle holes; and releasing pressure of the fluid in the ink chamber.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1A:
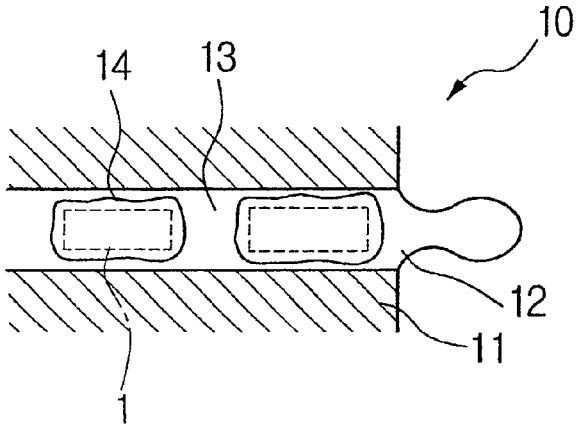
FIG. 1A (PRIOR ART)
FIGS. 1A and 1B are cross sectional plan views schematically illustrating conventional thermal and piezo-actuator ink jet printer heads, respectively.
Figure 1B:
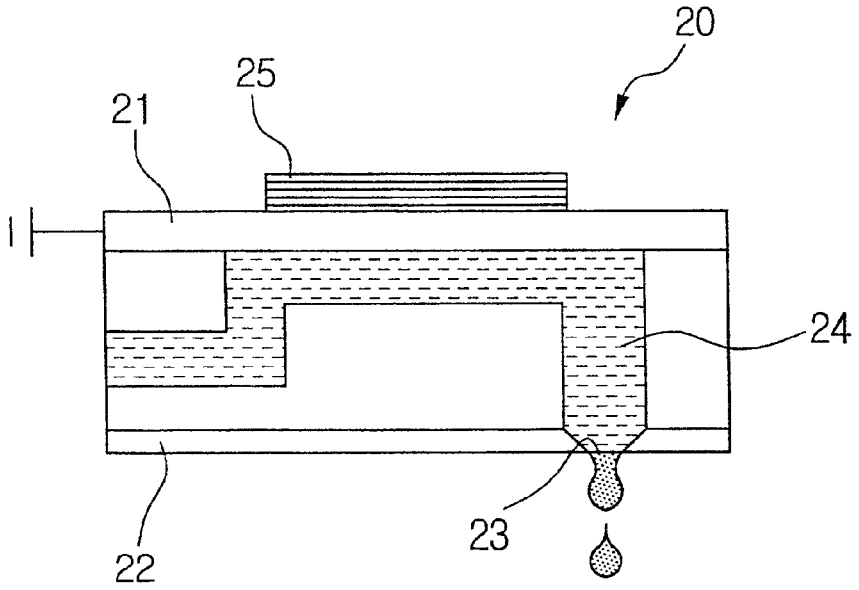
FIG. 1B (PRIOR ART)

First, referring to FIGS. 1A and 1B, FIGS. 1A and 1B are cross sectional views schematically illustrating a thermal ink jet printer head 10 and a piezo-actuator ink jet printer head 20, respectively. As shown in FIG. 1A, the thermal ink jet printer 10 head discharges ink through a nozzle hole 12 in such a manner that a thin-film heater resistor 11 instantly heats ink 1 of an ink chamber 13, generating and expanding ink bubbles 14. Accordingly, as the expanded ink bubbles pressure the ink chamber 13, the ink is discharged through the nozzle hole or opening 12.

Also referring to FIG. 1B, piezo-actuator ink jet printer head 20 discharges ink through a nozzle hole or opening 23 in such a manner that electric power is applied to a piezo-actuator 25 which is disposed on a silicon plate 21 and opposite to a nozzle plate 22, thereby displacing the piezo-actuator 25. Accordingly, an ink chamber 24 is pressured and the ink is discharged through the nozzle hole or opening 23.

Figure 2A:
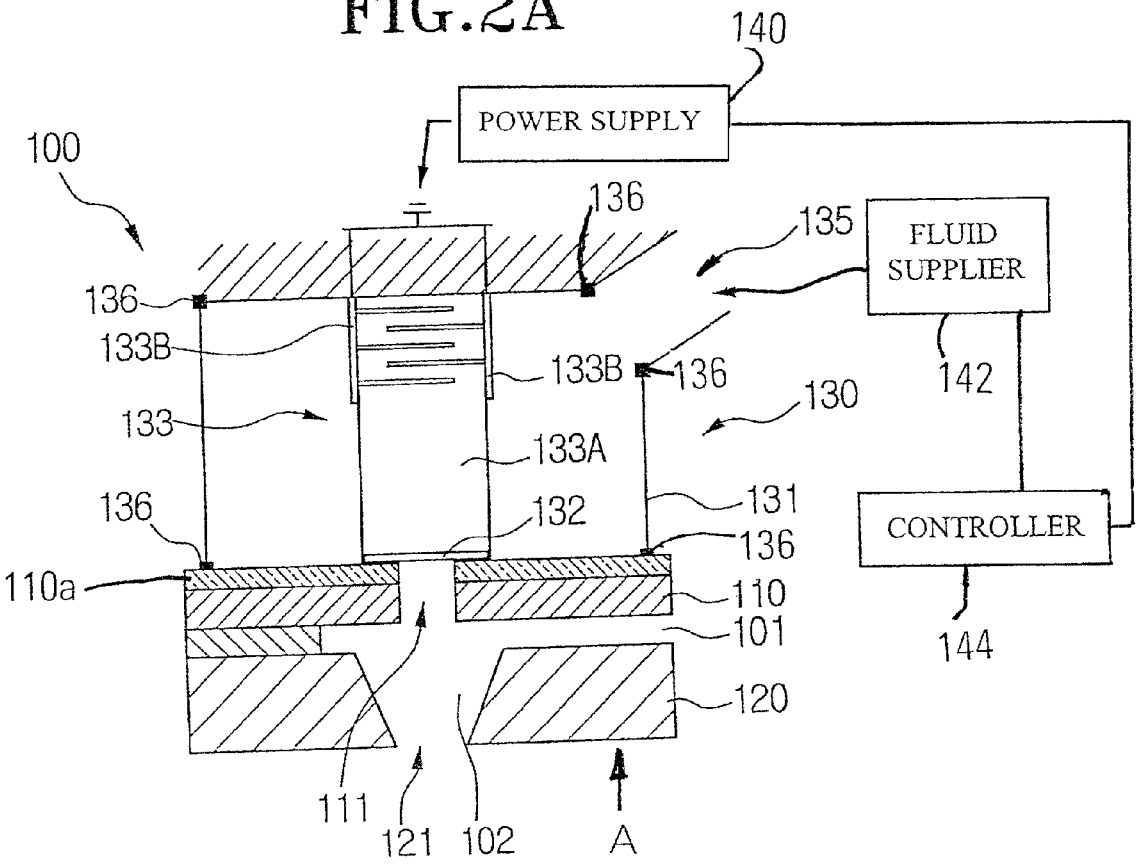
FIG. 2A is a cross sectional plan view schematically illustrating an ink jet printer head according to the present invention.
Figure 2B:
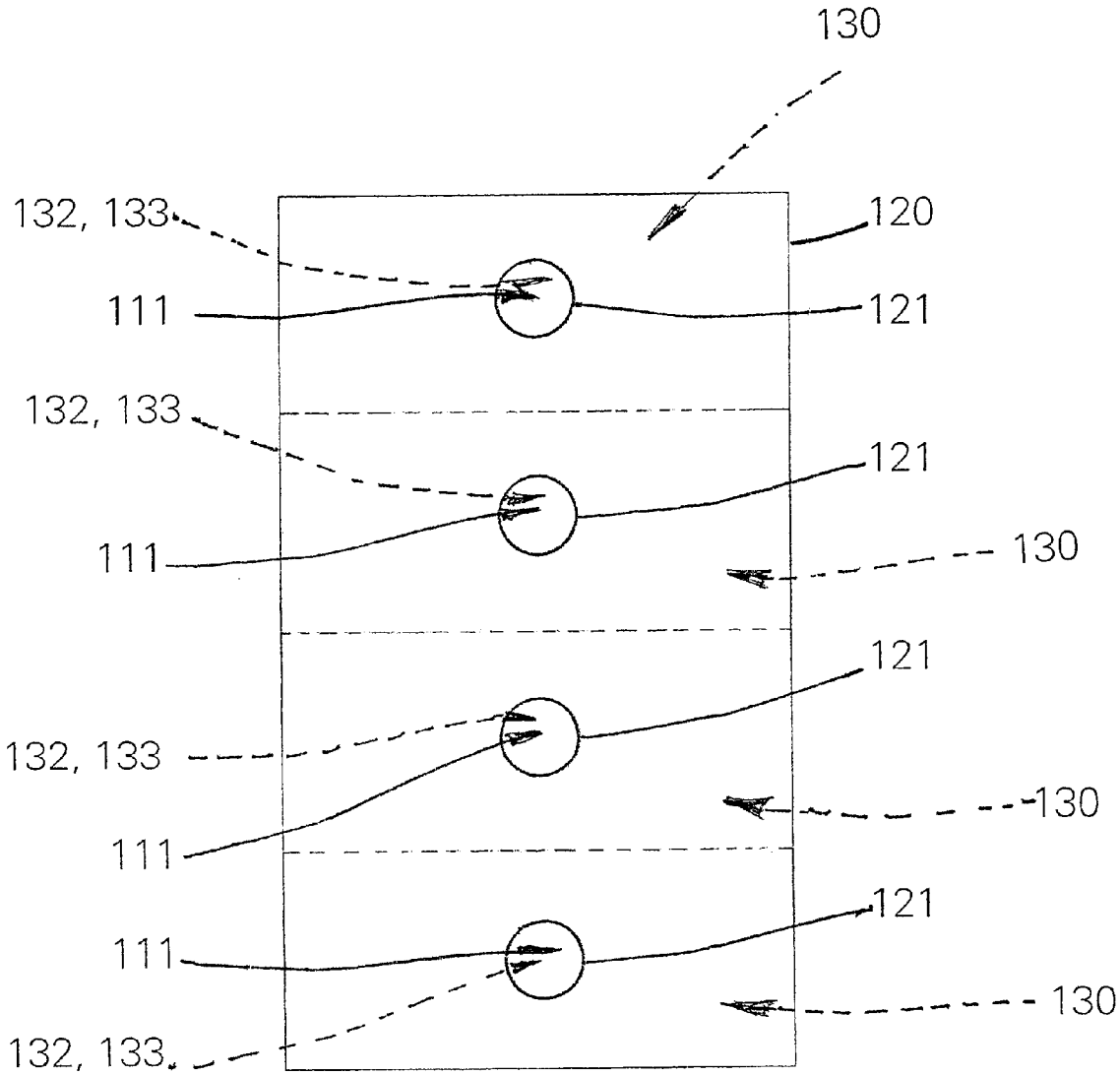
FIG. 2B is a bottom view of the ink jet printer head of FIG. 2A illustrating a plurality of nozzle holes or nozzle openings.

Continuing in reference to FIGS. 2A and 2B, FIGS. 2A and 2B illustrate an ink jet printer head 100 according to the present invention, with FIG. 2B schematically illustrating a bottom view of the ink jet printer head 100 of FIG. 2A in the direction of the arrow A in FIG. 2A. Ink jet printer head 100 includes a nozzle plate 120 having a plurality of nozzle holes or nozzle openings 121, a silicon plate 110 disposed adjacent to and parallel with the nozzle plate 120, for defining an ink flow path 101 for ink and an ink chamber 102 for receiving ink, and an ink discharge device 130 or a plurality of ink discharge devices 130 for discharging ink of a corresponding ink chamber 102 through a corresponding nozzle hole 121 or through a plurality of nozzle holes or openings 121, by a fluid pressure of air pressure or liquid pressure, for example.

According to the present invention, each ink discharge device 130 includes a through-hole or aperture 111 or a plurality of through-holes or apertures 111 formed in the silicon plate 110 correspondingly to a nozzle hole or opening 121 or to a plurality of nozzle holes or openings 121, a fluid chamber 131 defined on or in a side 110*a* of the silicon plate 110 to be charged with a fluid, an opening valve 132 or a plurality of opening valves 132 for selectively opening and closing a corresponding through-hole 111 or a corresponding plurality of through-holes or apertures 111, and an operation unit 133 or a plurality of operation units 133 for operating a corresponding opening valve 132 or a corresponding plurality of opening valves 132.

Each operation unit 133 includes an actuator for selectively lifting and lowering a corresponding opening valve 132. According to a preferred embodiment of the present invention, it is preferable that each operation unit 133 includes a piezo-actuator 133A layered on a corresponding opening valve 132, a plurality of electrode plates 133 B for driving the piezo-actuator 133A, and a power supply 140 for applying electric power to the plurality of electrode plates 133B.

Each ink discharge device 130 further includes an inflow channel 135 for supplying fluid to a corresponding fluid chamber 131, a fluid supplier 142, such as a pump, a controller 144 for controlling fluid pressure of the corresponding fluid chamber 131, in cooperation with the fluid supplier 142 and with the power supply 140 under control of the controller 144 in cooperation with the corresponding operation unit 133, and sealing members 136 for sealing the corresponding fluid chamber 131.

Figure 3A:
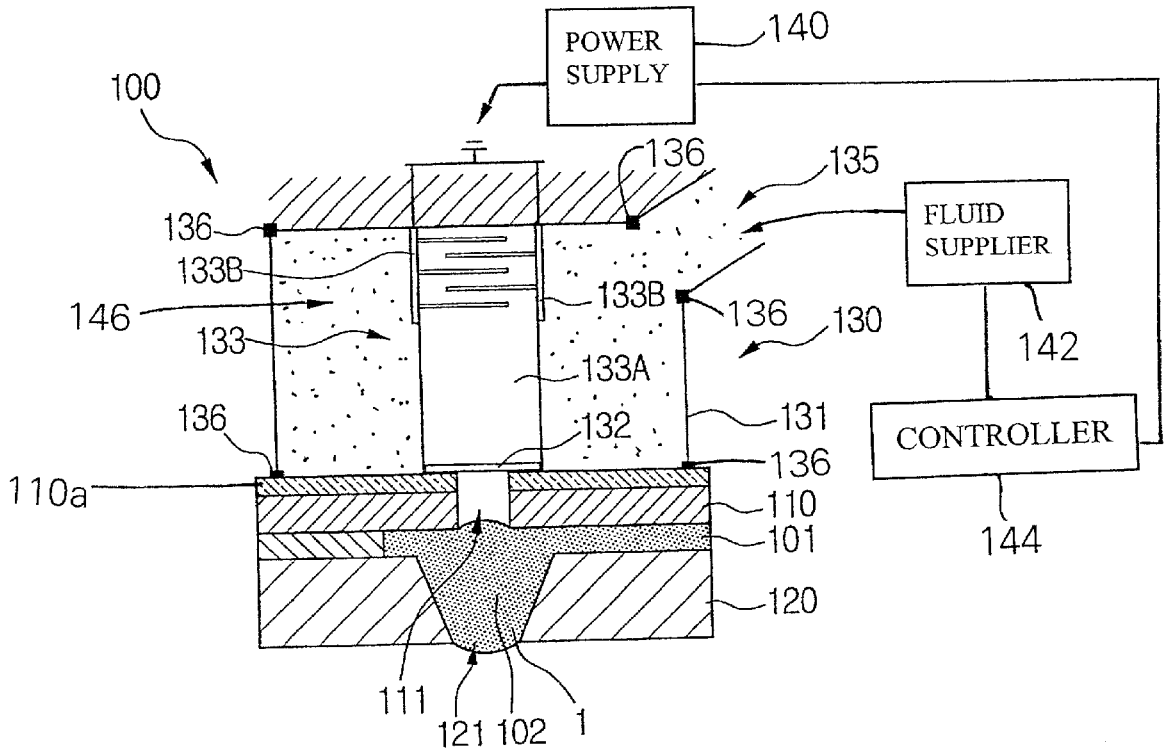
FIGS. 3A to 3D are cross sectional plan views illustrating an operational process of an ink jet printer head of FIGS. 2A and 2B according to the present invention.
Figure 3B:
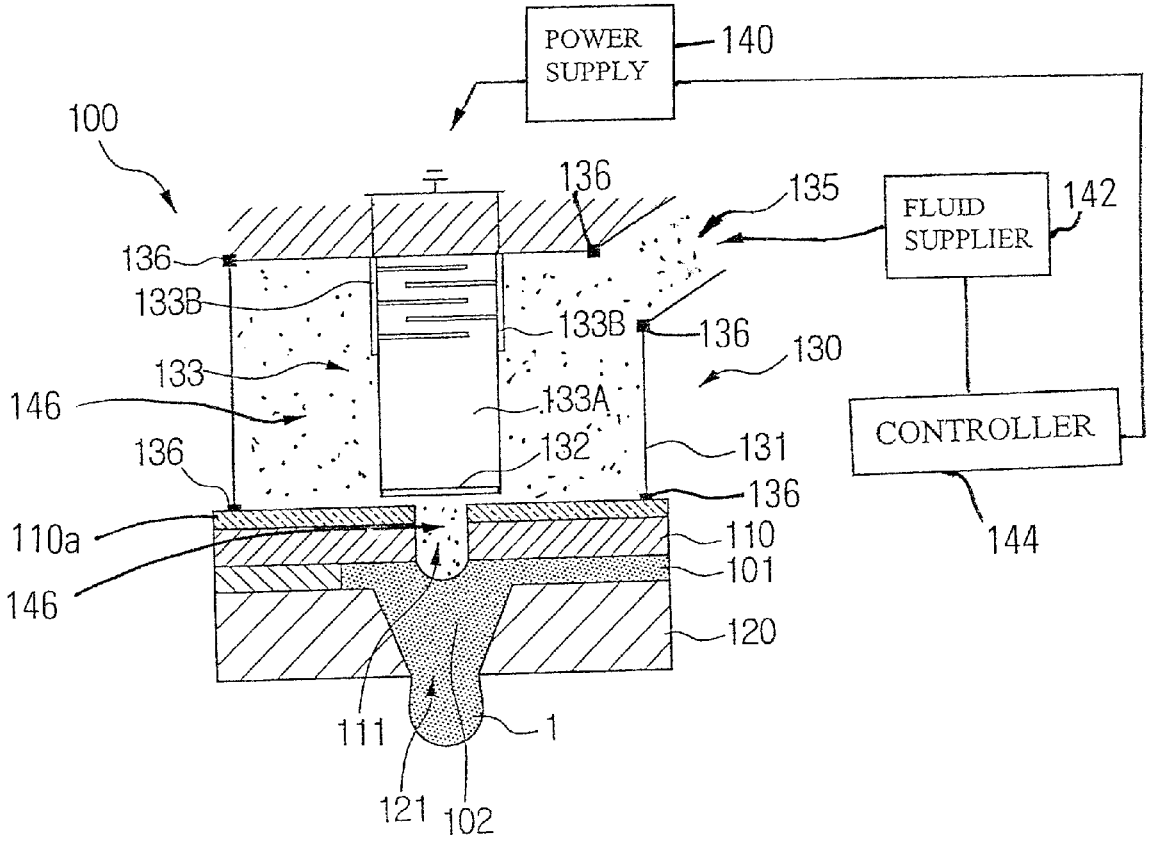

Referring to FIGS. 3A to 3D, an operational process and method for discharging ink of or from the ink jet printer head 100 of FIGS. 2A and 2B according to the present invention will now be described. First, as shown in FIG. 3A, for a corresponding discharge device 130, electric power is applied to electrode plates 133B from power supply 140 under the control of the controller 144 while ink 1 is charged in the corresponding ink chamber 102 through the ink flow path 101. Next, as shown in FIG. 3B, a piezo-actuator 133A is selectively displaced upward and downward and a corresponding opening valve 132 is selectively lifted and lowered. The above operation is typically performed in microseconds while being controlled by the controller 144 according to the speed of the ink discharge.

Figure 3C:
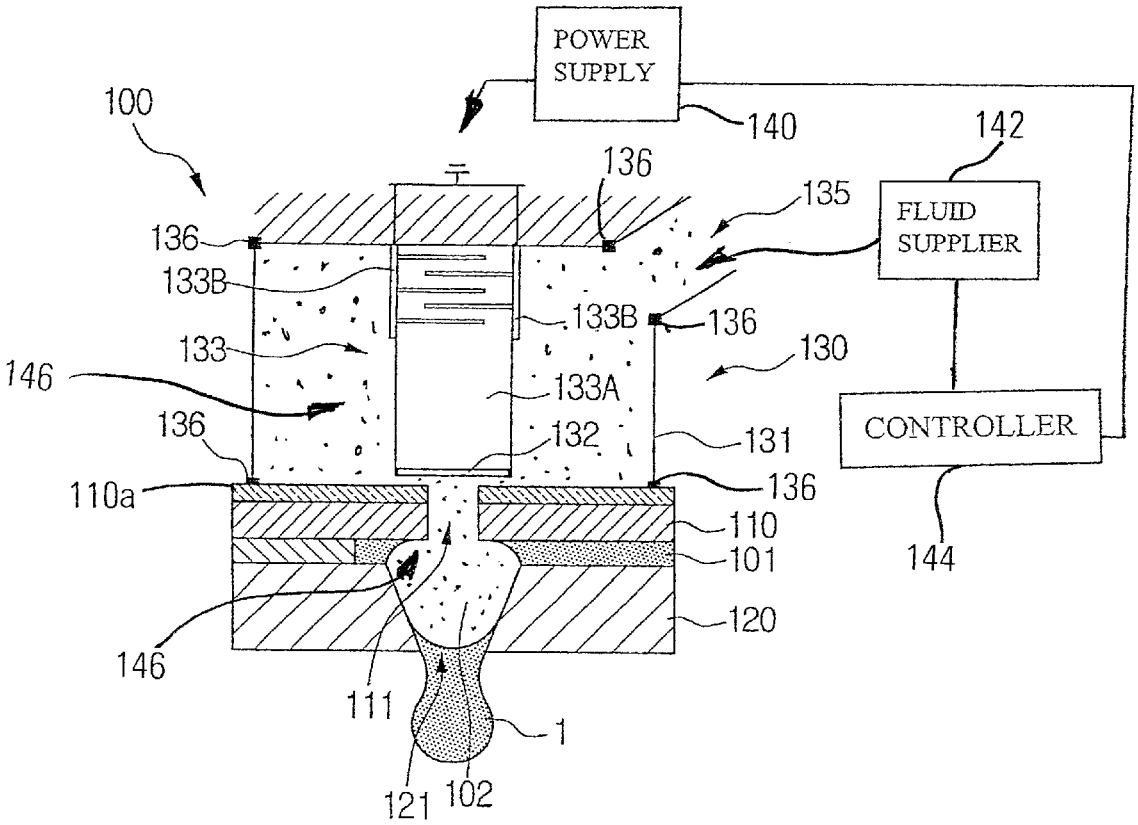

Continuing with reference to FIG. 3C, when the opening valve 132 is lifted by the piezo-actuator actuator 133A, a fluid 146, such as air, charged in the fluid chamber 131 flows through a corresponding through-hole or aperture 111 into the ink chamber 102 and pressures the ink 1. Accordingly, the ink 1 is discharged through a corresponding nozzle hole or opening 121.

Figure 3D:
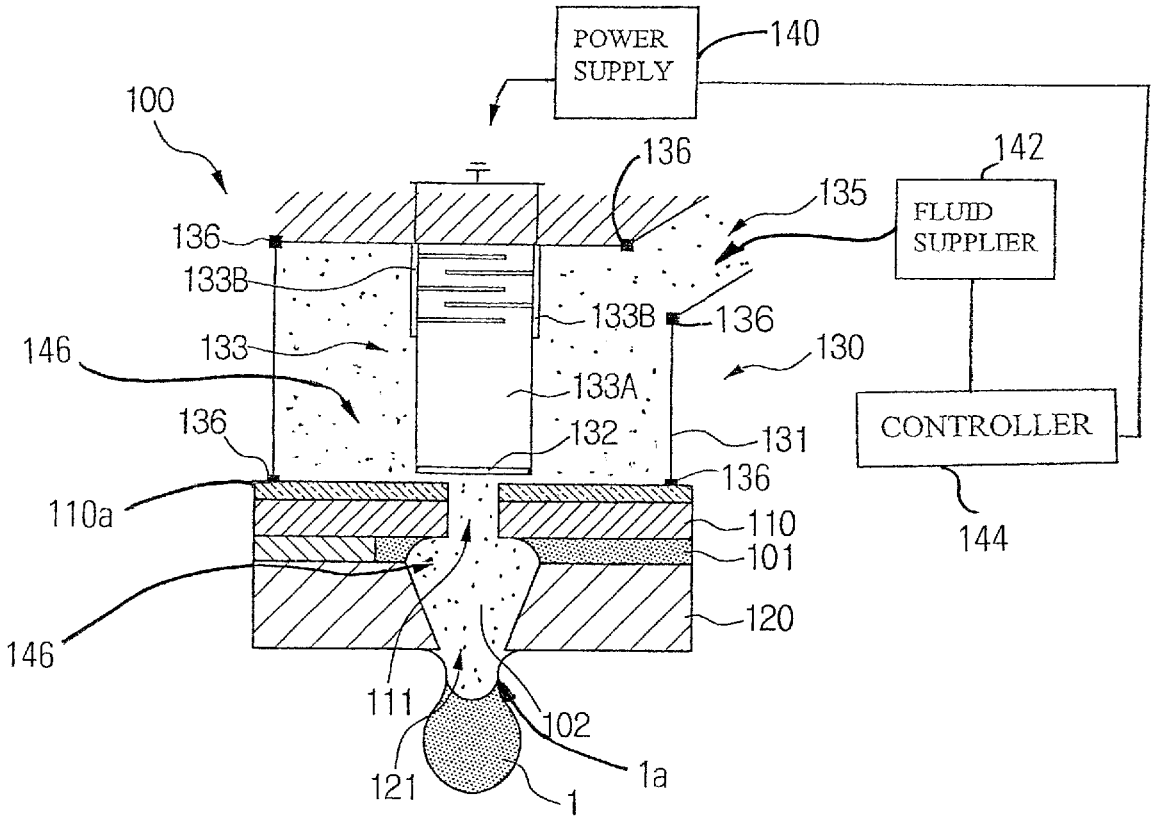

Moreover, as shown in FIG. 3D, even after the ink 1 is discharged through a corresponding nozzle hole or opening 121, the fluid 146, such as air, pressures the ink 1 for a predetermined period of time of a sufficient duration such that a tail 1*a* of the ink 1 is completely pushed out from a corresponding nozzle hole or opening 121. Thereafter, the pressure of the fluid 146, such as air, having air bubbles generated by air pressure is released in the ink chamber 102 after discharging the ink 1 through a corresponding nozzle hole or opening 121. Accordingly, by such fluid pressure of fluid 146, ink droplets of the ink 1 of a uniform shape or uniform shapes are discharged from a corresponding nozzle hole or opening 121.

In the method for discharging ink from the ink jet printer head 100 according to the present invention as described above with reference to FIGS. 2A through 3D, a fluid 146, such as air having air bubbles generated by air pressure, for example, is consistently supplied to the fluid chamber 131 of a corresponding ink discharge device 130 through an inflow channel 135 from a fluid supplier 142 during the ink discharge. The controller 144 controls the fluid pressure of the fluid 146, such as air, in the fluid chamber 131 so as to be of a consistent pressure. Although air is an example for a fluid 146 in a preferred embodiment of the present invention, other fluid forms, such as a gas or a liquid, can also be used for the fluid 146, for example.

In the ink jet printer head 100 according to the present invention as described above with reference to FIGS. 2A through 3D, uniform shapes of ink droplets can be discharged respectively through the nozzle hole or opening 121 or through a plurality of nozzle holes or openings 121, and ink discharge and drying of the ink discharged are advantageously hastened by the use of such fluid pressure as in the present invention, so that a high resolution print can be obtained.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An ink jet printer head, comprising:

a nozzle plate including a nozzle opening;

a base plate disposed in opposing relation to the nozzle plate for defining an ink flow path for ink;

an ink chamber communicating with the ink flow path for receiving the ink, the ink chamber communicating with the nozzle opening; and ink discharge means disposed over the base plate in corresponding relation to the ink chamber, the ink discharge means for providing fluid pressure by a fluid for discharging ink in the ink chamber through the nozzle opening by the fluid pressure, the ink discharge means comprising:

an aperture formed in the base plate in corresponding relation to the ink chamber and in corresponding relation to the nozzle opening;

a fluid chamber defined on a side of the base plate, the fluid chamber for being charged with the fluid for providing the fluid pressure; and an opening valve for selectively opening and closing the aperture, the selective opening of the opening valve providing for flow of the fluid from the fluid chamber through the aperture to the ink chamber to provide the fluid pressure by the fluid from the fluid chamber for discharging the ink in the ink chamber through the nozzle opening.

2. The ink jet printer head as claimed in claim 1, further comprised of the ink discharge means comprising:

an operation unit for operating the selective opening and closing of the opening valve.

3. The ink jet printer head as claimed in claim 2, further comprised of the ink discharge means further comprising:

an inflow channel disposed for guiding the fluid into the fluid chamber; and a controller for selectively controlling the fluid pressure in the fluid chamber, and the controller for selectively controlling the selective opening and closing of the opening valve by the operation unit.

4. The ink jet printer head as claimed in claim 2, further comprised of the operation unit comprising an actuator for selectively lifting and lowering the opening valve to selectively open and close the opening valve.

5. The ink jet printer head as claimed in claim 4, further comprised of the actuator comprising:

a piezo-actuator layered on the opening valve;

a plurality of electrode plates for driving the piezo-actuator; and a power supply for applying electric power to the plurality of electrode plates to drive the piezo-actuator.

6. The ink jet printer head as claimed in claim 5, further comprised of the fluid including air bubbles generated by air pressure to provide the fluid pressure.

7. The ink jet printer head as claimed in claim 5, further comprised of the fluid including one of a gas and a liquid to provide the fluid pressure.

8. The ink jet printer head as claimed in claim 1, further comprised of the fluid including air bubbles generated by air pressure to provide the fluid pressure.

9. The ink jet printer as claimed in claim 1, further comprised of the fluid including one of a gas and a liquid to provide the fluid pressure.

10. The ink jet printer head as claimed in claim 1, further comprised of:

the nozzle plate including a plurality of nozzle openings, each of the plurality of nozzle openings communicating with a corresponding ink chamber and with a corresponding ink discharge means to selectively discharge the ink through the plurality of nozzle openings; and each corresponding ink discharge means comprising:

a corresponding aperture formed in the base plate in corresponding relation to a corresponding ink chamber and in corresponding relation to a corresponding nozzle opening of the plurality of nozzle openings;

a corresponding fluid chamber defined on a side of the base plate, the corresponding fluid chamber for being charged with the fluid for providing the fluid pressure; and a corresponding opening valve for selectively opening and closing the corresponding aperture, the selective opening.of the corresponding opening valve providing for flow of the fluid from the corresponding fluid chamber through the corresponding aperture to the corresponding ink chamber to provide the fluid pressure by the fluid from the corresponding fluid chamber for discharging the ink in the corresponding ink chamber through the corresponding nozzle opening of the plurality of nozzle openings.

11. The ink jet printer head as claimed in claim 10, further comprised of each corresponding ink discharge means comprising:

a corresponding operation unit for operating the selective opening and closing of the corresponding opening valve.

12. The ink jet printer head as claimed in claim 11, further comprised of each corresponding ink discharge means further comprising:

a corresponding inflow channel disposed for guiding the fluid into the corresponding fluid chamber; and a controller for selectively controlling the fluid pressure in the corresponding fluid chamber, and the controller for selectively controlling the selective opening and closing of the corresponding opening valve by the corresponding operation unit.

13. The ink jet printer head as claimed in claim 11, further comprised of the corresponding operation unit comprising a corresponding actuator for selectively lifting and lowering the corresponding opening valve to selectively open and close the corresponding opening valve.

14. The ink jet printer head as claimed in claim 13, further comprised of the corresponding actuator comprising:

a piezo-actuator layered on the corresponding opening valve;

a plurality of electrode plates for driving the piezo-actuator; and a power supply for applying electric power to the plurality of electrode plates to drive the piezo-actuator.

15. The ink jet printer head as claimed in claim 14, further comprised of the fluid including air bubbles generated by air pressure to provide the fluid pressure.

16. The ink jet printer as claimed in claim 14, further comprised of the fluid including one of a gas and a liquid to provide the fluid pressure.

17. The ink jet printer head as claimed in claim 10, further comprised of the fluid including air bubbles generated by air pressure to provide the fluid pressure.

18. The ink jet printer as claimed in claim 10, further comprised of the fluid including one of a gas and a liquid to provide the fluid pressure.

19. A method for discharging ink from an ink jet printer head, comprising the steps of:

supplying ink to an ink chamber which is formed in communication with a base plate and a nozzle plate of the ink jet printer head, the nozzle plate including a nozzle opening;

pressuring the ink in the ink chamber by contacting the ink in the ink chamber by a fluid to provide a fluid pressure on the ink;

discharging the ink in the ink chamber through the nozzle opening using the fluid pressure on the ink in the ink chamber;

applying the fluid pressure on the ink discharged from the ink chamber for a predetermined period of time of a duration such that a tail of the ink is discharged from the ink chamber through the nozzle opening; and releasing the fluid pressure in the ink chamber after discharging the ink through the nozzle opening.

20. The method as claimed in claim 19, further comprised of the fluid including air bubbles generated by air pressure to provide the fluid pressure on the ink.

21. The method as claimed in claim 19, further comprised of the fluid including one of a gas and a liquid to provide the fluid pressure on the ink.

22. A method for discharging ink from an ink jet printer head, comprising the steps of:

supplying ink to an ink chamber corresponding to a nozzle opening of a plurality of nozzle openings, each corresponding ink chamber being formed in communication with a base plate and a nozzle plate of the ink jet printer head, the nozzle plate including the plurality of nozzle openings;

pressuring the ink in the corresponding ink chamber by contacting the ink in the corresponding ink chamber by a fluid to provide a fluid pressure on the ink in the corresponding ink chamber;

discharging selectively the ink in the corresponding ink chamber through a corresponding nozzle opening of the plurality of nozzle openings using the fluid pressure on the ink in the corresponding ink chamber;

applying the fluid pressure on the ink discharged from the corresponding ink chamber for a predetermined period of time of a duration such that a tail of the ink is discharged from the corresponding ink chamber through the corresponding nozzle opening of the plurality of nozzle openings; and releasing the fluid pressure in the corresponding ink chamber after discharging selectively the ink through the corresponding nozzle opening of the plurality of nozzle openings.

23. The method as claimed in claim 22, further comprised of fluid including air bubbles generated by air pressure to provide the fluid pressure on the ink in the corresponding ink chamber.

24. The method as claimed in claim 22, further comprised of the fluid including one of a gas and a liquid to provide the fluid pressure on the ink in the corresponding ink chamber.

* * * * *